United States Patent [19]

Wilhelm et al.

[11] Patent Number: 4,567,397

[45] Date of Patent: Jan. 28, 1986

[54] ELECTRIC LAMP HAVING A LIGHT SOURCE ALIGNED TO A CAP

[75] Inventors: Dieter Wilhelm, Eschweiler; Werner Schlagheck, Aachen-Laurensberg; René Toussaint, Herzogenrath, all of Fed. Rep. of Germany

[73] Assignee: U.S. Philips Corporation, New York, N.Y.

[21] Appl. No.: 497,986

[22] Filed: May 25, 1983

[30] Foreign Application Priority Data

Jun. 5, 1982 [DE] Fed. Rep. of Germany ..... 3221290

[51] Int. Cl.[4] ..... H01J 5/48; H01J 5/58; H01J 5/60

[52] U.S. Cl. ..... 313/318; 339/144 R

[58] Field of Search ..... 313/318; 339/144 R, 339/144 T, 145 R, 145 D, 145 T, 146

[56] References Cited

U.S. PATENT DOCUMENTS

| | | | |
|---|---|---|---|
| 2,878,060 | 3/1959 | Russo | 206/0.5 |
| 3,093,768 | 6/1963 | Ayres | 339/145 D |
| 3,173,735 | 3/1965 | Fenn | 313/318 |
| 3,281,620 | 10/1966 | Miller | 313/318 |
| 3,534,217 | 10/1970 | Vause et al. | 313/318 |
| 3,739,221 | 6/1973 | Degleyker et al. | 339/145 D |
| 3,898,506 | 8/1975 | Willoughby et al. | 339/144 R |
| 4,012,658 | 3/1977 | Vause | 339/144 R |
| 4,119,877 | 10/1978 | Grewe et al. | 339/145 R |
| 4,122,367 | 10/1978 | Esklavon et al. | 313/318 |
| 4,295,076 | 10/1981 | Eckhardt et al. | 339/146 |
| 4,371,807 | 2/1983 | Eckhardt et al. | 339/146 |
| 4,384,236 | 5/1983 | Hellwig et al. | 339/144 R |
| 4,396,860 | 8/1983 | Hellwig et al. | 339/145 R |
| 4,463,278 | 7/1984 | Kosmatka et al. | 339/154 L |
| 4,464,600 | 8/1984 | Kosmatka et al. | 339/145 R |
| 4,485,326 | 11/1984 | Hellwig et al. | 313/318 |
| 4,495,436 | 1/1985 | Notelteirs | 313/318 |

FOREIGN PATENT DOCUMENTS

| | | | |
|---|---|---|---|
| 1022007 | 3/1966 | United Kingdom | 313/318 |

*Primary Examiner*—Steven Weinstein
*Attorney, Agent, or Firm*—David R. Treacy

[57] ABSTRACT

An electric lamp having a tubular metal cap, in which a metal sleeve is arranged. The pinch of a lamp envelope is accommodated in the sleeve with a clamping fit. The cap has at least three depressions which are distributed around its circumference and which are each secured to the sleeve. The inner diameter of the cap—apart from the depressions—is larger than the outer diameter of the sleeve over the whole length of the cap opposite the sleeve. The light source of this lamp can be aligned in three directions with respect to the cap by longitudinal movement and pivoting, about transverse axes before the sleeve securing the cap to the lamp envelope without the use of cement.

21 Claims, 16 Drawing Figures

ELECTRIC LAMP HAVING A LIGHT SOURCE ALIGNED TO A CAP

BACKGROUND OF THE INVENTION

The invention relates to an electric lamp having tubular cap mainly consisting of metal, and a lamp envelope having a pinch. An electric light source is arranged in the envelope, and source current conductors extend through the pinch to the exterior and are electrically connected to the cap, the pinch being received with a clamping fit by a metal sleeve secured in the cap.

An electric lamp of this kind described in the non-prepublished European Patent Application No. 82200902, to which U.S. Pat. No. 4,495,436 has the advantage with respect to conventional lamps that the cap is secured to the lamp envelope without cement, whilst nevertheless the lamp has a pretermined focal length (=distance of the light source from a reference point on the cap). It is important to avoid the use of cement because heat and time are required for hardening and cement in warm surroundings is decomposed and can crumble off.

When lamps are used in an optical system, it is of importance that the light source occupies a predetermined position. Accurate positioning requires that the light source be arranged in a predetermined position with respect to the cap. In the lamp according to the aforementioned U.S. Pat. No. 4,495,436, the focal length is adjusted, it is true, in a direction parallel to the cap axis but a lateral displacement of the light source with respect to the cap axis is not possible. The lamp cannot be aligned in three dimensions and therefore cannot be utilized for all applications.

A lamp is known from Dutch Patent Specification No. 64742, in which a sleeve is secured to the lamp envelope by means of a cement. A cap is provided on the sleeve, the cap having at its open end an inwardly bent edge, which surrounds the sleeve with clamping fit. Two diametrically oppositely arranged tongues are pressed out of the sheath of the cap to the interior and are welded to the sleeve. Although in this lamp the focal length is adjustable, a three-dimensional alignment is not possible.

A method of securing without cement a lamp envelope provided with a pinch in a cap with the aid of a tubular inner part which receives the pinch with clamping fit is known from German Offenlegungsschrift No. 2938189, to which U.S. Pat. No. 4,371,807 corresponds. The inner part, provided with inwardly bent pairs of lugs for receiving the pinch of the envelope, closely engages the cap so that also in this case a longitudinal movement and a rotary movement of the lamp envelope with the inner part opposite the cap is possible, but a pivotal movement about transverse axes is precluded.

From the British Pat. No. 450,948 an electric lamp is known, whose lamp envelope is secured with the aid of cement in a spherically curved ring, which could be aligned in three dimensions with respect to the cap. The connection between the cap and the inner part is made by means of soldering, for which purpose the cap is provided with three holes for receiving the solder. These holes containing the connection solder limit the alignment process, more particularly in the longitudinal direction.

A manner of holding the pinch of the envelope is known from German Pat. No. 140,817, to which British patent application No. 2,042,823A published Sept. 24, 1980 corresponds.

SUMMARY OF THE INVENTION

The object of the invention is to provide an electric lamp having generally circular-cross-section tubular cap, in which a cementless unit composed of a lamp envelope and a sleeve is arranged so that it can be aligned in three dimensions and is then secured.

In a lamp of the kind mentioned in the opening paragraph, this is achieved according to the invention in that the cap has at least three depressions which lie generally in a plane perpendicular to the cap axis and are distributed around its circumference. Each of the depressions is secured to the sleeve. The inner diameter of the cap—apart from the depressions—is larger than the diameter of the outer surface of the sleeve over the whole length of the of the cap opposite the sleeve.

Since the sleeve diameter is smaller than the cap, the sleeve not only can be rotated and longitudinally displaced, but can also be pivoted with respect to the cap about axes perpendicular to the cap axis, the depressions then serving as points of rotation in the pivoting process.

The depressions may have the form of, for example, oval, conical or spherical indents or of tongues punched out of the cap and pressed inwards. When the depressions—related to the average diameter of the sleeve—have an excess dimension of at least 0.1 mm, a kind of tight fit is obtained when the sleeve is inserted into the cap. The axial shear forces to be applied because of the tight fit can be kept small also with larger manufacturing tolerances when, according to an advantageous embodiment of the invention, the sleeve widens conically towards the lamp envelope.

In the lamp according to the invention, comparatively large tolerances are possible for the inner diameter of the cap and for the outer diameter of the sleeve due to the fact that the differences in diameter are compensated for by the depth of the depressions. Moreover, different focal lengths can be obtained by a corresponding choice of the length of the sleeve.

In an advantageous embodiment, the sleeve is provided with pairs of lugs which are arranged opposite each other, are bent inwardly and hold the pinch of the envelope. According to a further embodiment of the invention, for further locking against displacement in longitudinal direction, a strip left between each pair of lugs has an inwardly directed resilient part, for example, a tongue or an indent, which engages in a locking manner a corresponding depression of the pinch of the envelope. For the same purpose, the pairs of lugs may also be provided with slots, which are engaged by profiles formed on the pinch of the envelope.

In a further embodiment of the lamp in accordance with the invention, the sleeve is provided with two oppositely arranged pairs of longitudinal ribs, between which the pinch of the envelope is clamped. Such longitudinal ribs can be formed in a comparatively simple manner by means of a deep-drawing method, and are shown in British patent application No. 2,041,823A referred to above.

In another embodiment, the pinch of the envelope projects through the bottom of the sleeve and the pinch is held by a pair of lugs provided on the bottom of the sleeve. In a modification of this embodiment, the lugs engage behind cams present on the pinch in order to further improve locking in the longitudinal direction.

In very advantageous embodiments of lamps according to the invention, sleeve open end adjoins the lamp envelope by its open end. The lamp envelope is then in a very stable position.

In another very advantageous embodiment, one of the current conductors is secured to the sleeve, for example, welded or soldered to a possibly conical tube provided on the sleeve or to a, for example, U-shaped tongue provided on the sleeve.

The cap and the sleeve can be secured to each other by soldering or welding; and more particularly, by resistance welding.

Various kinds of metals can be used for forming the cap and the sleeve, such as brass and other copper alloys, which may be nickel-plated, and aluminum.

The invention will be described more fully with reference to the accompanying drawing.

DESCRIPTION OF THE PREFERRED EMBODIMENTS

Figure 1:
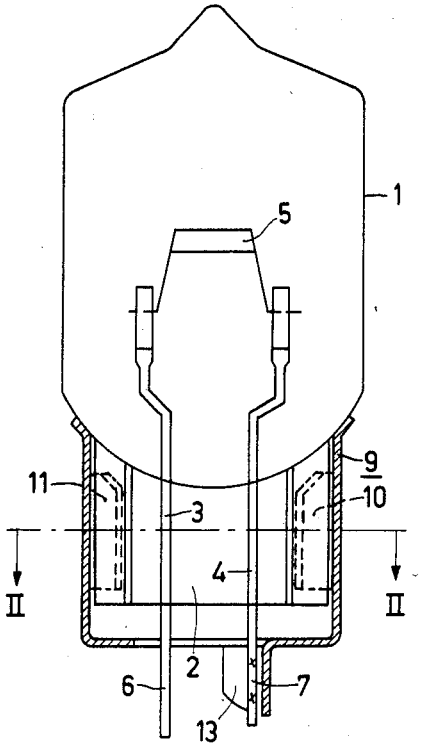
FIG. 1 shows a lamp unit comprising a lamp envelope arranged in a sleeve, the incandescent lamp envelope being represented in side elevation and the sleeve in longitudinal cross-section.
Figure 3:
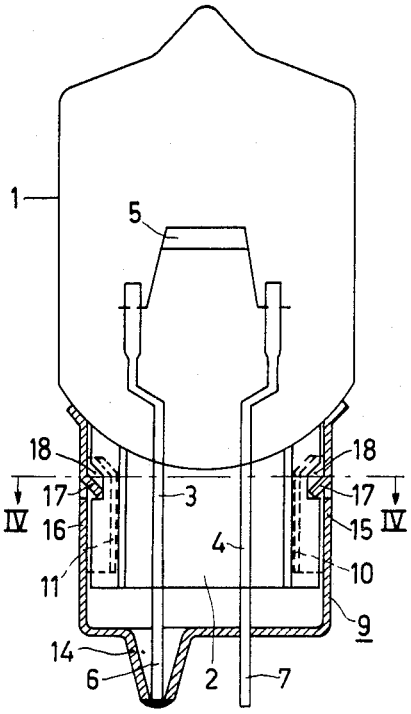
FIG. 3 shows a modification of the lamp unit shown in FIG. 1.
Figure 2:
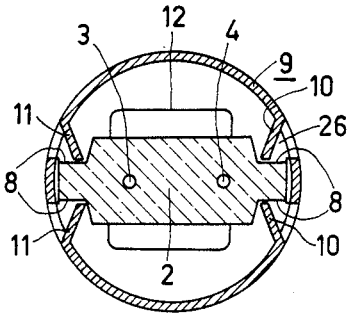
FIG. 2 is a cross-sectional view of the lamp unit shown in FIG. 1 taken on the line II—II.

In FIGS. 1 and 3, reference numeral 1 denotes an envelope made of, for example, hard glass or quartz glass of a halogen incandescent lamp, which at its end has a pinch 2 of substantially rectangular cross-section, in which current conductors 3 and 4 of molybdenum are embedded, which run towards a coiled filament 5 serving as an electric light source, the ends 6 and 7 of these conductors projecting from the pinch 2. The pinch 2 is provided with depressions 8 on its two minor sides.

The lamp envelope 1 is held at its pinch 2 in a sleeve 9 of sheet metal, which abuts at its open end against the lamp envelope. For this purpose, the sleeve 9 is provided with pairs of lugs 10 and 11, respectively, which are punched out, extend in the axial direction of the lamp, are arranged opposite each other, are bent inwardly and between which the pinch 2 of the envelope with its depressions 8 is inserted with clamping fit. The sleeve 9, which slightly conically widens towards the envelope 1, is provided at its bottom with an opening 12 for the ends 6 and 7 of the current-supply wires 3 and 4. Moreover, in FIG. 1 there is formed on the bottom of the sleeve 9 a U-shaped contact 13, to which the wire end 7 is electrically connected first by clamping and then by spot-welding.

Figure 4:
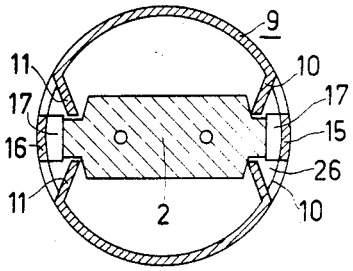
FIG. 4 is a cross-sectional view of the lamp unit shown in FIG. 3 taken on the line IV—IV.

The lamp unit shown in FIGS. 3 and 4 differs from that described so far mainly in that the sleeve 9, instead of being provided with a U-shaped contact, is provided with a drawn cone 14, to which the wire end 6 is attached by soldering or welding. Besides, the strips 15 and 16 left between the pairs of lugs 10 and 11 each have as a resilient part an inwardly bent resilient tongue 17, which engages in a locking manner a corresponding depressions 18 of the pinch 2 of the envelope. The lamp envelope 1 is locked against rotation in the sleeve 9 by the pairs of lugs 10 and 11, and a further locking in longitudinal direction is attained by resilient parts 17 engaging the cap depressions 18.

Figure 5:
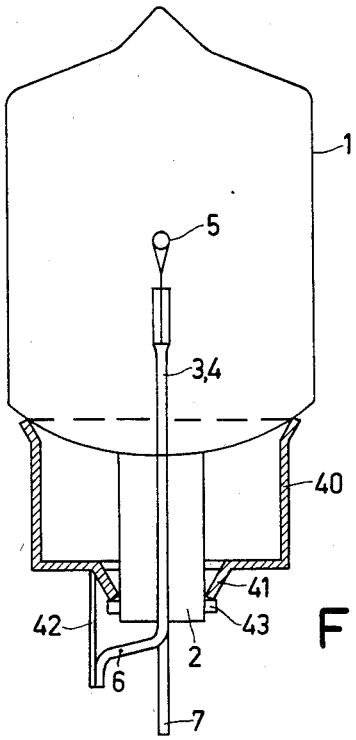
FIG. 5 shows a further lamp unit, the lamp envelope being represented in side elevation and the sleeve in longitudinal cross-section.

In FIG. 5, the incandescent lamp 1,2,3,4,5 is equal to that shown in FIG. 1, but the pinch 2 has a cam 43. The sleeve 40 corresponds to that of the aforementioned U.S. Pat. No. 4,495,436. The sleeve 40 has a pair of lugs 41 which hold with clamping fit the pinch 2 of the incandescent lamp and engage behind the cam 43. The sleeve 40 is provided with a tongue 42, to which the current conductor 6 is welded. The unit can be mounted in the caps of FIGS. 6 and 8. The open end of the sleeve 40 abuts against the lamp envelope 1.

Figure 6:
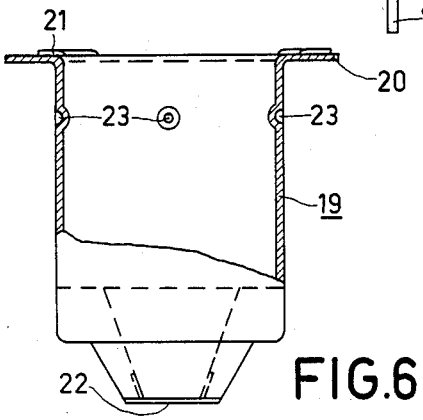
FIG. 6 shows a sleeve-shaped cap, which is adapted to receive a lamp unit as shown in FIG. 1 or 3, partly in side elevation and partly in longitudinal cross-section.
Figure 8:
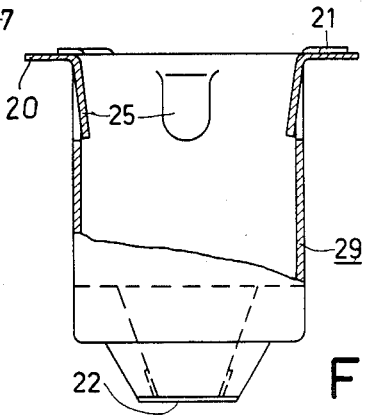
FIG. 8 shows a modification of the cap shown in FIG. 6.
Figure 10:
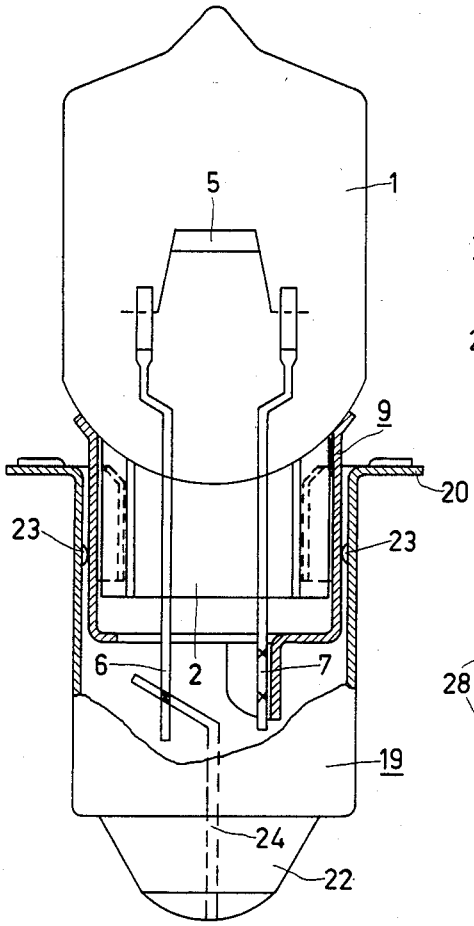
FIG. 10 shows an incandescent lamp composed of a lamp unit as shown in FIGS. 1 and 2 arranged in a cap as shown in FIGS. 6 and 7, partly in side elevation and partly in longitudinal cross-section.

The lamp units shown in FIGS. 1 and 3 can be arranged in a sleeve-shaped cap of thin sheet metal shown in FIG. 6 or 8. The cap 19 shown in FIGS. 6 and 7 has the form of a sleeve and is provided with a cap collar 20, on which reference markers 21 are provided for correct insertion into an associated holder. The cap 19 has a central cap contact 22. The cap 19 is provided with four spherical indents 23, which are distributed over its circumference and which, when a lamp unit as shown in FIG. 1 is inserted, each form a pointed contact with the sleeve 9 (FIG. 10). The inner diameter of the cap 19—apart from the indents 23—is larger than the outer diameter of the sleeve 9 over its whole length opposite the sleeve 9. In this manner, the lamp unit of FIG. 1 can not only be longitudinally displaced and rotated with respect to the cap 19, but can also be pivoted so that the coiled filament 5 can be aligned in three dimensions with respect to the cap 19. After the alignment, the sleeve 9 is welded to the cap 19 at the area of its indents 23. As is apparent from FIG. 10, the free end 6 of the current supply wire 3 has welded to it a lengthening wire 24 of manganese-nickel, which is soldered to the cap contact 22.

Figure 7:
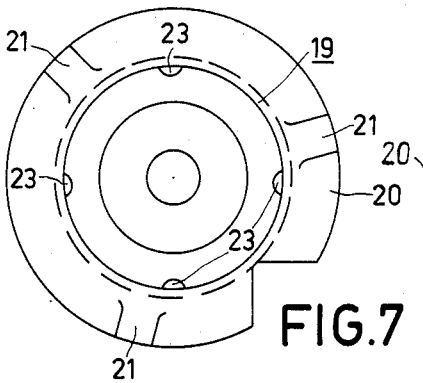
FIG. 7 is a plan view of the cap of FIG. 6.
Figure 9:
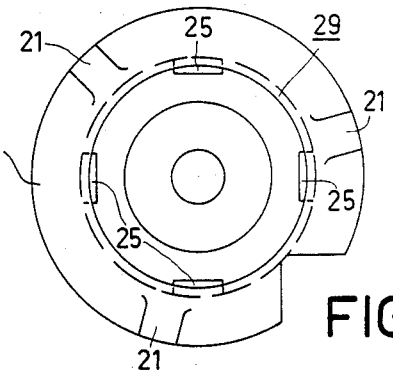
FIG. 9 is a plan view of the cap of FIG. 8.

The sleeve-shaped cap 29 as shown in FIGS. 8 and 9 substantially corresponds to the cap 19 as shown in FIGS. 6 and 7. Corresponding parts are therefore designated by the same reference symbols. Instead of indents, the cap 29 has four resilient tongues 25 as depressions, which are punched out and pressed inwards and which upon insertion of a lamp unit as shown in FIG. 1 or 3 can also be connected after the alignment to the sleeve 9 by spot-welding.

The connection between the sleeve 9 and the caps 19 and 29, respectively, may alternatively be established, however, by soft soldering. In this case, the pockets 26, which have been obtained by punching out the pairs of lugs 10 and 11 in the sleeve 9, are utilized as a space for receiving the soldering paste. The soldering paste is applied before the sleeve is inserted into the cap. During the insertion, the soldering paste is partly distributed as a film between the sleeve and the cap. Subsequently, only the cap has to be heated externally in order to obtain a soldered connection between it and the sleeve.

Figure 11:
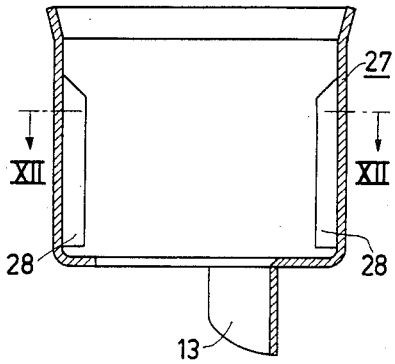
FIG. 11 is a longitudinal sectional view of a further sleeve for receiving a lamp envelope.
Figure 12:
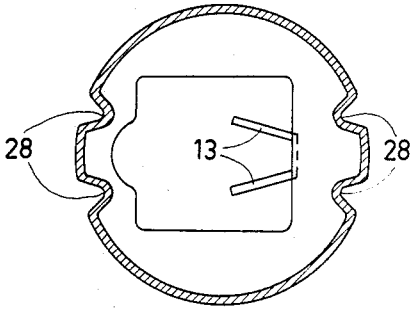
FIG. 12 is a cross-sectional view of the sleeve shown in FIG. 11 taken on the line XII—XII.
Figure 13:
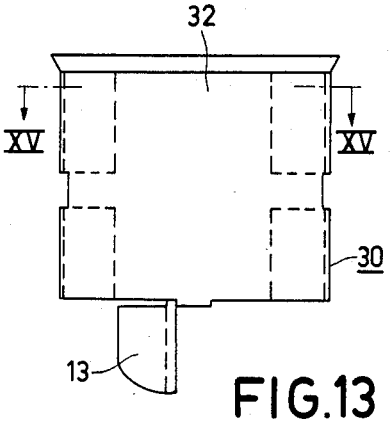
FIG. 13 is a side elevation of another embodiment of a sleeve.
Figure 14:
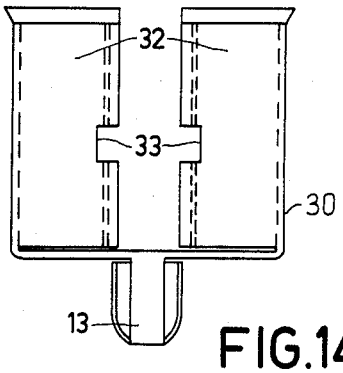
FIG. 14 shows an elevation of the sleeve of FIG. 13 rotated through 90° about the longitudinal axis.
Figure 15:
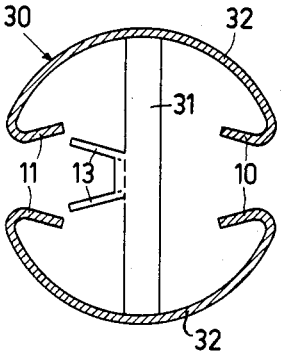
FIG. 15 is a cross-sectional view of the sleeve of FIG. 13 taken on the line XV—XV.
Figure 16:
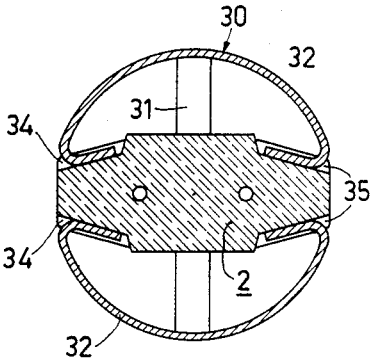
FIG. 16 shows a cross-section corresponding to that of FIG. 15 of the sleeve with an inserted envelope pinch.

The sleeve 27, shown in FIGS. 11 and 12, is provided with a U-shaped contact 13 and has two pairs of oppositely arranged longitudinal ribs 28, between which a pinch 2 of the envelope can be clamped. These longitudinal ribs 28 are also suitable to be used as pockets for receiving soldering material. The sleeves described so far were manufactured by deep-drawing.

Another embodiment of a sleeve 30, in the form of a punched part, is shown in FIGS. 13 to 16. The sleeve 30 consists of a bottom part 31 having two sheath halves 32, which are curved into substantially the form of a semicircle and whose edges are bent inwardly to form pairs of lugs 10 and 11, respectively, and are adapted to receive the pinch 2 of the envelope. The pairs of lugs 10 and 11 are provided with transverse slots 33, which engage in a locking manner transverse profiles 34 provided on the pinch 2 of the envelope. The spaces 35 between the sheath halves 32 and the pinch 2 can again be used for receiving soldering material. The sleeve 30 is provided at its bottom part 31 with a U-shaped contact 13 for receiving the end of a current supply wire.

What is claimed is:

1. An electric lamp comprising a generally circular-cross-section tubular cap formed mainly of metal and defining an axis; a lamp envelope having a pinch, an electric light source arranged in the envelope, and source current conductors extending through the pinch to the envelope exterior and electrically connected to the cap; and a metal sleeve having an outer surface and secured in the cap, the pinch being received with a clamping fit in the sleeve, characterized in that the cap has at least three inwardly directed depressions which lie generally in a plane perpendicular to the cap axis and are distributed around the cap circumference with each depression forming a point of contact with the outer surface of the sleeve, aside from the depressions, the inner diameter of the cap is larger than the outer surface of the sleeve over the whole length of the cap opposite the sleeve such that prior to securement of said sleeve to said cap the lamp envelope together with said sleeve can not only be longitudinally displaced and rotated with respect to the cap but can also be pivoted with the depressions serving as points of rotation so that the light source can be aligned in three dimensions with respect to the cap, said at least three depressions being secured to said sleeve to maintain the alignment.

2. A lamp as claimed in claim 1, characterized in that the sleeve widens conically towards the lamp envelope.

3. A lamp as claimed in claim 1, characterized in that the sleeve is provided with oppositely arranged inwardly bent pairs of lugs which hold the pinch.

4. A lamp as claimed in claim 1, characterized in that a strip left between each pair of lugs has a resilient inwardly directed part which engages in a locking manner a corresponding depression of the pinch.

5. A lamp as claimed in claim 1, characterized in that the pairs of lugs are provided with slots which engage profiles provided on the pinch.

6. A lamp as claimed in claim 1, characterized in that the sleeve is provided with two oppositely arranged pairs of longitudinal ribs, between which the pinch is clamped.

7. A lamp as claimed in claim 1, characterized in that one of said current conductors projects from the pinch and is secured to the sleeve.

8. A lamp as claimed in claim 1, characterized in that the depressions have the form of indents.

9. A lamp as claimed in claim 8, characterized in that the sleeve widens conically towards the lamp envelope.

10. A lamp as claimed in claim 8, characterized in that the sleeve is provided with oppositely arranged inwardly bent pairs of lugs which hold the pinch.

11. A lamp as claimed in claim 8, characterized in that a strip left between each pair of lugs has a resilient inwardly directed part which engages in a locking manner a corresponding depression of the pinch.

12. A lamp as claimed in claim 8, characterized in that the pairs of lugs are provided with slots which engage profiles provided on the pinch.

13. A lamp as claimed in claim 8, characterized in that the sleeve is provided with two oppositely arranged pairs of longitudinal ribs, between which the pinch is clamped.

14. A lamp as claimed in claim 8, characterized in that one of said current conductors projects from the pinch and is secured to the sleeve.

15. A lamp as claimed in claim 1, characterized in that the depressions are tongues punched out of the cap and pressed inwards.

16. A lamp as claimed in claim 15, characterized in that the sleeve widens conically towards the lamp envelope.

17. A lamp as claimed in claim 15, characterized in that the sleeve is provided with oppositely arranged inwardly bent pairs of lugs which hold the pinch.

18. A lamp as claimed in claim 15, characterized in that a strip left between each pair of lugs has a resilient inwardly directed part which engages in a locking manner a corresponding depression of the pinch.

19. A lamp as claimed in claim 15, characterized in that the pairs of lugs are provided with slots which engage profiles provided on the pinch.

20. A lamp as claimed in claim 15, characterized in that the sleeve is provided with two oppositely arranged pairs of longitudinal ribs, between which the pinch is clamped.

21. A lamp as claimed in claim 15, characterized in that one of said current conductors projects from the pinch and is secured to the sleeve.

* * * * *